US010281121B2

(12) United States Patent
Bader et al.

(10) Patent No.: US 10,281,121 B2
(45) Date of Patent: May 7, 2019

(54) SYSTEM FOR THERMALLY DECOUPLED MOUNTING OF LIGHT FIXTURES

(71) Applicant: ZUMTOBEL LIGHTING GMBH, Dornbirn (AT)

(72) Inventors: Martin Bader, Dornbirn (AT); Wolfgang Bechter, Hittisau (AT); Wolfgang Gadner, Horbranz (AT); Gerald Ladstatter, Klaus (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 66 days.

(21) Appl. No.: 15/524,414

(22) PCT Filed: Dec. 11, 2015

(86) PCT No.: PCT/EP2015/079407
§ 371 (c)(1),
(2) Date: May 4, 2017

(87) PCT Pub. No.: WO2016/096651
PCT Pub. Date: Jun. 23, 2016

(65) Prior Publication Data

US 2018/0283660 A1 Oct. 4, 2018

(30) Foreign Application Priority Data

Dec. 17, 2014 (DE) ..... 20 2014 106 112 U

(51) Int. Cl.
*F21V 21/04* (2006.01)
*F21S 8/02* (2006.01)
(Continued)

(52) U.S. Cl.
CPC ..... *F21V 21/041* (2013.01); *F21S 8/024* (2013.01); *F21S 8/026* (2013.01); *F21V 21/14* (2013.01); *F21V 29/10* (2015.01)

(58) Field of Classification Search
None
See application file for complete search history.

(56) References Cited

U.S. PATENT DOCUMENTS 2,744,716 A * 5/1956 Zingone ..... F21V 21/00 220/3.6
3,058,611 A * 10/1962 Chester ..... E04B 9/006 220/3.5
(Continued)

FOREIGN PATENT DOCUMENTS

DE 90174038 4/1991
DE 10 2004 011581 9/2005
(Continued)

OTHER PUBLICATIONS

German search report in priority German Application 20 2014 106 112.6 dated Jul. 6, 2015.
(Continued)

*Primary Examiner* — Elmito Breval
(74) *Attorney, Agent, or Firm* — Andrus Intellectual Property Law

(57) ABSTRACT

A mounting system (1) for mounting a light fixture comprises two substantially L-shape designed receiving rails (4*a*, 4*b*). The receiving rails (4*a*, 4*b*) each have a first leg (5*a*, 5*b*) which is designed to be fastened to a front side of a suspended wall or an underside of a suspended ceiling (2) on a respective opposite edge of a recess (3) of the wall or ceiling (2). The receiving rails (4*a*, 4*b*) each further comprise a second leg (6*a*, 6*b*) which is designed to protrude into the recess (3) and to carry a light fixture housing (10) of the light fixture, but without connecting the light housing (1) rigidly to the first legs (5*a*, 5*b*) of the receiving rails (4*a*, 4*b*).

11 Claims, 2 Drawing Sheets

(51) Int. Cl.
*F21V 29/10* (2015.01)
*F21V 21/14* (2006.01)

(56) References Cited

U.S. PATENT DOCUMENTS

| | | | | | |
|---|---|---|---|---|---|
| 3,700,885 | A * | 10/1972 | Bobrick | F21S 8/02 | 248/343 |
| 4,450,512 | A * | 5/1984 | Kristofek | F21S 8/02 | 362/147 |
| 4,745,533 | A * | 5/1988 | Smerz | F21S 8/02 | 362/364 |
| 5,077,650 | A * | 12/1991 | Cestari | F21V 21/04 | 362/147 |
| 5,581,448 | A * | 12/1996 | Harwood | F21S 8/02 | 362/147 |
| 5,826,970 | A * | 10/1998 | Keller | F21S 8/02 | 362/147 |
| 5,967,640 | A * | 10/1999 | Moriyama | F21S 8/02 | 362/147 |
| 6,095,671 | A * | 8/2000 | Hutain | F21S 2/00 | 362/373 |
| 6,364,511 | B1 * | 4/2002 | Cohen | F21S 8/02 | 362/148 |
| 7,399,104 | B2 * | 7/2008 | Rappaport | F21S 8/02 | 362/147 |
| 7,677,770 | B2 * | 3/2010 | Mazzochette | F21S 8/026 | 362/294 |
| 9,591,390 | B2 * | 3/2017 | Humphreys | | |
| 9,746,195 | B2 * | 8/2017 | Yang | F24F 13/078 | |
| 2004/0177572 | A1 | 9/2004 | Burgess | | |
| 2005/0002182 | A1 | 1/2005 | Kotovsky | | |
| 2005/0252666 | A1 | 11/2005 | Kotovsky | | |
| 2007/0206374 | A1 * | 9/2007 | Petrakis | F21S 8/02 | 362/147 |
| 2012/0113642 | A1 * | 5/2012 | Catalano | F21S 8/02 | 362/249.02 |

FOREIGN PATENT DOCUMENTS

| | | |
|---|---|---|
| EP | 2787274 | 1/2014 |
| WO | 2005124054 | 12/2005 |
| WO | 2014020015 | 2/2014 |

OTHER PUBLICATIONS

International Search Report in parent PCT Application PCT/EP2015/079407 dated Mar. 7, 2016.

Austria search report in copending Austria Application GM 172/2015 dated Nov. 4, 2016.

* cited by examiner

SYSTEM FOR THERMALLY DECOUPLED MOUNTING OF LIGHT FIXTURES

CROSS REFERENCE TO RELATED APPLICATION

The present application is the U.S. national stage application of International Application PCT/EP2015/079407, filed Dec. 11, 2015, which international application was published on Jun. 23, 2016 as International Publication WO 22016-096651 A1. The International Application claims priority to German Patent Application 20 2014 106 112.6, filed Dec. 17, 2014.

FIELD OF THE INVENTION

The invention relates to a mounting system for thermally decoupled installation of light fixtures and a corresponding light fixture system.

BACKGROUND OF THE INVENTION

Conventionally, recessed light fixtures for suspended ceilings and walls are attached directly to a cut-out in the suspended ceiling or wall. For this, first the drywall hanger must prepare a cut-out, in which the electrician subsequently installs the light fixture. The drywall hanger must subsequently plaster the light fixture flush with the surface. This solution is not only labor intensive, because the two workers must interact, but it also tends to result in crack formation at the edges of the cut-out, and in particular in the corners of the cut-out, because the light fixture housing is not thermally decoupled from the plastered surface.

Thus, WO 2014/020015 A1 discloses a mounting system for light fixtures, with which there is direct, permanent connection of the edges of the cut-out, in which the light fixture is to be installed, to the light fixture housing. The solution disclosed therein requires a great deal of installation effort, and is prone to crack formation along the edges and in particular the corners of the cut-out.

SUMMARY OF THE INVENTION

The object of the invention is therefore to create a mounting system for installing light fixtures, which requires little installation effort and at the same time ensures a long service life.

The object is achieved for the device according to the invention.

A mounting system according to the invention for installing a light fixture has two substantially L-shaped receiving rails. The receiving rails each have a first leg, which is designed to be attached to a front surface of a suspended ceiling or an undersurface of a suspended ceiling, on respective opposing edges of a cut-out of the wall or ceiling. The receiving rails furthermore each have a second leg, which is configured to engage in the cut-out, or extend therein, and to support a light fixture housing of the light fixture, without rigidly connecting the light fixture housing to the first leg of the receiving rail. In this manner, the light fixture housing can expand and contract, without this movement being transferred to the receiving rails and thus the edges of the cut-out. This also results in a simple installation.

The receiving rails are preferably designed to be disposed at a defined first spacing to one another, measured between the second legs. The edges of the cut-out are disposed at a second spacing to one another, which is greater than the first spacing. As a result, there are spacings between the second legs of the receiving rails and the edges of the cut-out. These spacings ensure that a particularly good thermal decoupling exists between the edges of the cut-out and the light fixture housing. Moreover, an additional mechanical decoupling is also obtained.

The second legs of the receiving rails preferably have receiving elements, preferably projections or profiles, which are designed to support the light fixture housing, without rigidly connecting the light fixture housing to the first legs of the receiving rails. In this manner, a particularly simple installation can be obtained.

The receiving elements are preferably designed to support the light fixture housing in a floating manner. Alternatively or additionally, the second legs of the receiving rails have a flexible design, such that they compensate for a thermally induced size change of the light fixture housing, without transferring the size change to the first legs of the receiving rails or to the edges of the cut-out. Thus, crack formation is also avoided through mechanical measures, in particular a mechanical decoupling.

The receiving elements are furthermore preferably designed to thermally decouple the light fixture housing and the receiving rails. In this manner, a heat transfer to the receiving rails, and thus to the edges of the cut-out, is avoided. Crack formation through expansion of the receiving rails and/or the edges of the cut-out is thus avoided.

The receiving rails preferably have plastering edges, which are configured to enable the first leg to be plastered flush to a surface of the wall or ceiling. In this manner, a particularly clean surface appearance is enabled. Moreover, the drywall hanger is able complete his work before the electrician begins as a result.

The mounting system preferably furthermore has two edge receiving plates, which are adapted to attach to the end regions of the cut out, in order to connect the receiving rails, and to thermally decouple the end regions of the cut-out from the receiving rails. A "connection" in this context does not necessarily mean a mechanical connection, but can also refer in some cases to a purely visual connection, wherein the edge receiving plates thus extend at least substantially over the entire width of both receiving rails, or both first legs thereof, respectively. The edge receiving plates are advantageous, in particular, because the most frequent location of crack formation is in the corners of the cut-out. Crack formation can be avoided more effectively through (mechanical and) thermal decoupling of the corners of the cut-out, which are encompassed by the edge receiving plates.

The second legs of the receiving rails are preferably furthermore adapted to retain covers and/or lenses and/or other components in a plane of the wall or ceiling. For this, either the previously specified receiving elements, or additional receiving elements (profiles, etc.) of the second leg can serve, for example, as at least a stop for the cover/lens that is to be inserted, seen in the direction of insertion. In this manner, enhanced installation flexibility can be obtained. In particular, additional mounts for covers, lenses, etc. can be eliminated.

A light fixture system according to the invention comprises a previously described mounting system, a light fixture having a light fixture housing, and a suspended ceiling or wall. The receiving rails are attached thereby with their respective first legs to a front surface of the suspended wall or an undersurface of the suspended ceiling at opposite edges of a cut-out in the wall or ceiling. The second legs of the receiving rails engage in the cut-out, or extend therein, respectively, and support the light fixture housing, without rigidly connecting the light fixture housing to the first legs of the receiving rails. A simple installation is obtained therewith, while at the same time, crack formation in the wall or ceiling is avoided.

The light fixture system preferably has a housing receiving unit, which is disposed on a back surface of the wall or ceiling in the region of the cut-out, which encompasses and/or supports light fixture housings, and closes off the cut-out to the back surface of the wall or ceiling. As a result, the receiving rails do not have to support the (entire) load of the light fixture housing. A particularly simple mechanical and thermal decoupling is thus possible.

BRIEF DESCRIPTION OF THE DRAWINGS

The invention shall be explained by way of example below, based on the drawings in which an advantageous exemplary embodiment of the invention is depicted. Therein.

DETAILED DESCRIPTION

Figure 1:
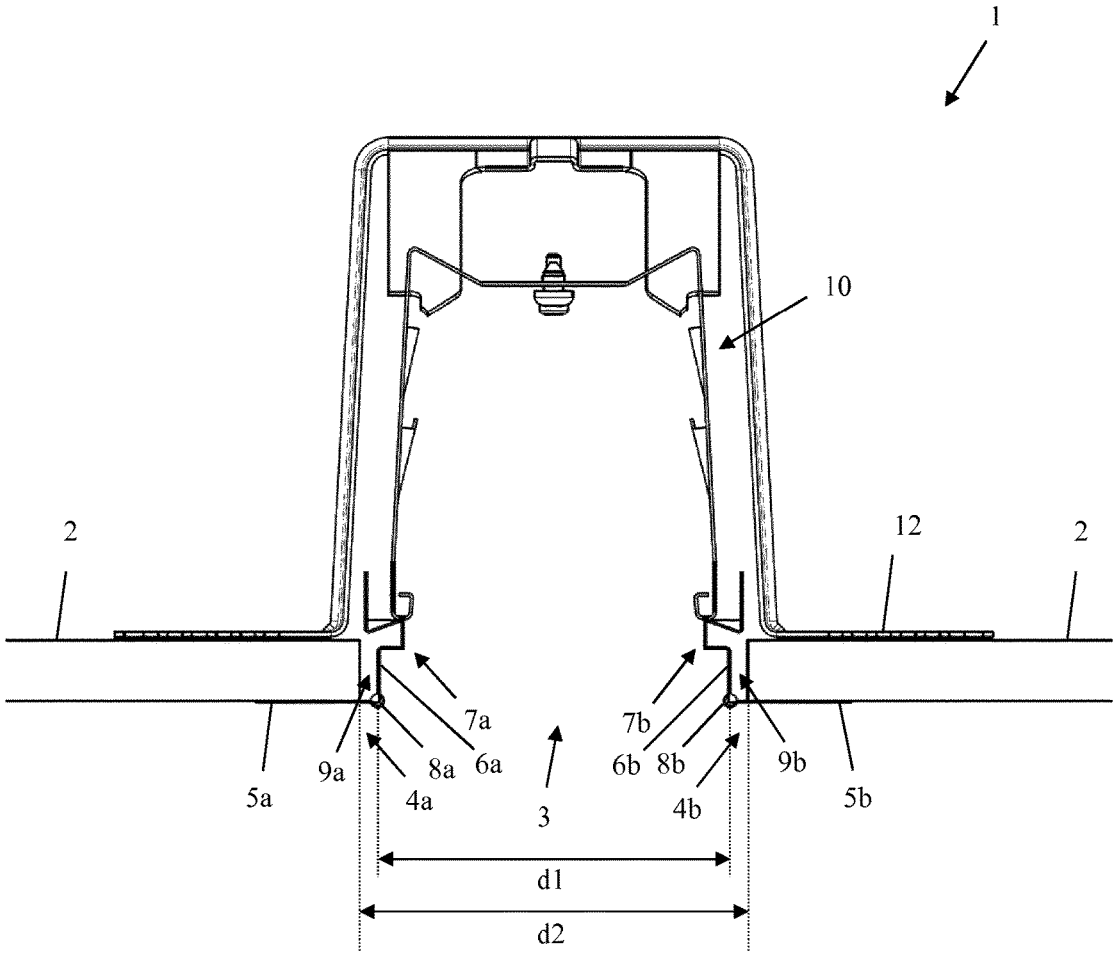
FIG. 1 shows a first exemplary embodiment of the mounting system according to the invention, in a sectional view.
Figure 2:
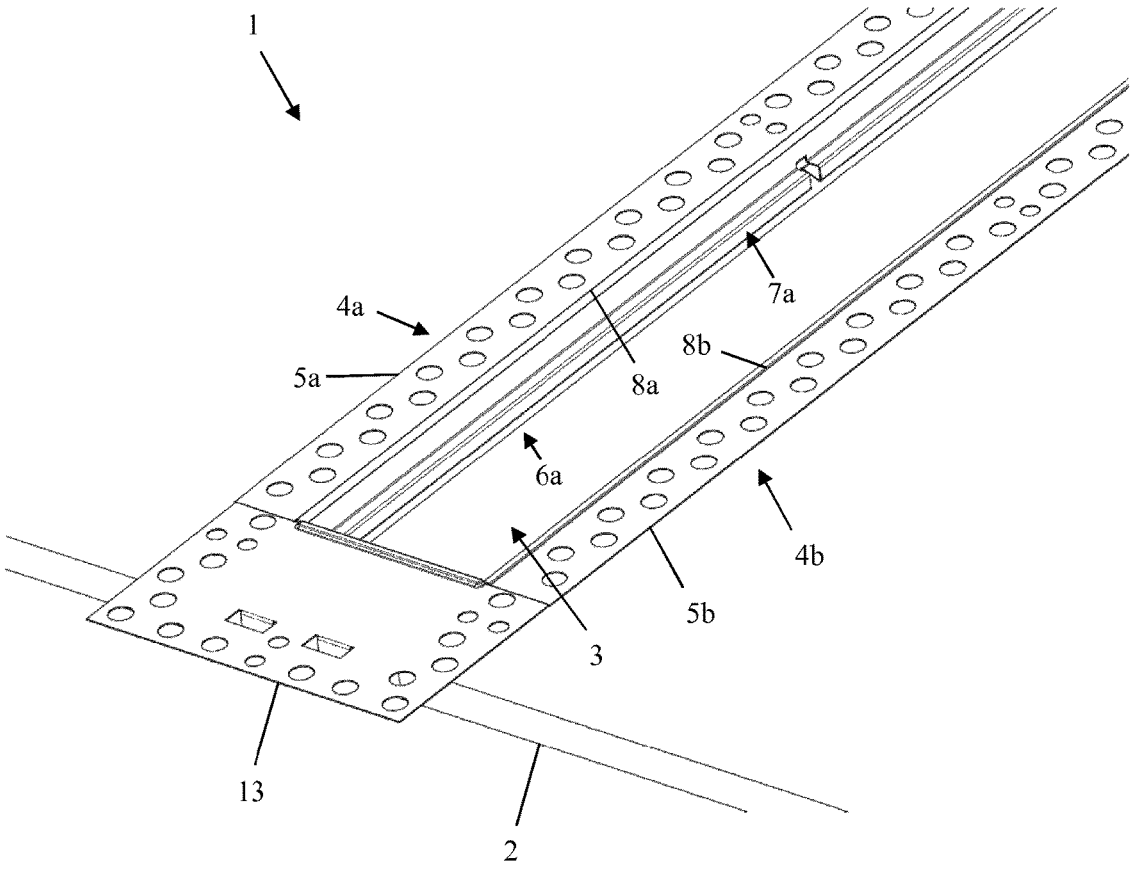
FIG. 2 shows a second exemplary embodiment of the mounting system according to the invention, in a perspective detailed view.

A detailed description of the construction and functionality of the mounting system according to the invention shall be given based on FIGS. 1 and 2. Not all identical elements shall be depicted and described repeatedly in similar illustrations.

A first exemplary embodiment of the light fixture system according to the invention is shown in FIG. 1. The light fixture system comprises a light fixture housing 10, which is installed above the suspended ceiling 2 in the region of a cut-out 3 in a suspended ceiling 2. The light fixture housing 10 is held in position with L-shaped receiving rails 4*a* and 4*b*. The receiving rails 4*a* and 4*b* are a component of the mounting system according to the invention. The receiving rails 4*a* and 4*b* each have a first leg 5*a* and 5*b*, with which they are attached to the undersurface of the suspended ceiling 2. They can be screwed or tacked thereto. The receiving rails furthermore each have a second leg 6*a* and 6*b*, which engages in the cut-out, or extends therein, and supports the light fixture housing 10, without rigidly connecting the light fixture housing 10 to the first legs 5*a* and 5*b* of the receiving rails 4*a* and 4*b*, thus supporting the light fixture housing 10 in a "floating" manner. In particular, the light fixture housing 10 is supported by projections or profiles 7*a* and 7*b* of the second legs 6*a* and 6*b*, which form receiving elements.

The cut-out 3 has a spacing d2 in the region of the receiving rails 4*a* and 4*b*, while the second legs 6*a* and 6*b* of the receiving rails 4*a* and 4*b* exhibit a second spacing d1 to one another. The spacing d1 of the second legs 6*a* and 6*b* to one another is less than the width d2 of the cut-out 3. The spacing d1 is thus smaller than the spacing d2. As a result, spacings 9*a* and 9*b* are formed between the legs 6*a* and 6*b* and the edges of the cut-out 3. The spacings 9*a* and 9*b* support a thermal decoupling of the light fixture housing 10 from the edges of the cut-out 3 in the suspended ceiling 2. Moreover, the second legs 6*a* and 6*b* can have a flexible design, such that they can compensate as needed for thermal expansions of the light fixture housing through lateral movement into the spacings 9*a* and 9*b*, or in the opposite direction.

Moreover, the receiving rails 4*a* and 4*b* ensure that the spacings 9*a* and 9*b* can be balanced via the first legs 5*a* and 5*b*. In this manner—in contrast to the conventional means of attachment—the cut-out 3 can be provided with more play, which simplifies the installation of the system according to the invention.

The receiving rails 4*a* and 4*b* furthermore have plastering edges 8*a* and 8*b*, which enable the first legs 5*a* and 5*b* of the receiving rails 4*a* and 4*b* to be plastered flush to the undersurface of the suspended ceiling 2. The plastering edges 8*a* and 8*b* face away from the suspended ceiling 2 (downward) when the system has been installed, thus substantially transverse to the first leg or aligned with the second leg. As a result, the drywall hanger can complete his work, in particular, of installing the receiving rails 4*a* and 4*b*, and subsequently plastering the receiving rails 4*a* and 4*b* at the plastering edges 8*a* and 8*b*. The electrician can install the light fixture housings 10 without the drywall hanger having to do any subsequent retouching.

The second legs 6*a* and 6*b* of the receiving rails 4*a* and 4*b* are additionally designed to retain further components, e.g. lenses or covers for a light fixture in the region of the plane of the suspended ceiling 2. In this manner, cut-outs 3 not currently being used for a light fixture can be readily covered. Alternatively, cut-outs 3 currently being used for a light fixture can readily be provided with a lens, which then does not have to be integrated in the light fixture.

The light fixture system depicted herein preferably has an additional housing receiving unit 12, which is disposed on the upper surface of the suspended ceiling in the region of the cut-out 3. The housing receiving unit 12 encompasses the light fixture housing 10, and, optionally, also supports it. Furthermore, the housing receiving unit 12 closes off the cut-out 3 in relation to the back surface of the suspended ceiling 2.

In the exemplary embodiments depicted herein, reference is made only to a suspended ceiling. This is not to be understood to be a limitation, however. The elements 2 can likewise be a suspended wall or suchlike.

A second exemplary embodiment of the mounting system 1 according to the invention is shown in a perspective view in FIG. 2. The light fixture housing and the housing receiving unit are not depicted herein for purposes of clarity.

Lateral edges of the cut-out 3 are covered herein by the receiving rails 4*a* and 4*b* having the spacings 9*a* and 9*b* depicted in FIG. 1.

An edge receiving plate 13, not shown in FIG. 1, is also shown herein, which is inserted in an end region of the cut-out 3, and preferably connects the receiving rails 4*a* and 4*b*, or at least extends transversely over the cut-out 3, preferably at least substantially over the entire width of the receiving rails 4*a* and 4*b*, or their first legs 5*a* and 5*b*. In the latter case, the edge receiving plates 13 can even be slightly spaced apart from the receiving rails 4*a* and 4*b*, e.g. in order to provide an expansion gap with respect to the receiving rails 4*a* and 4*b*. The edge receiving plates 13 serve as an additional (mechanical and) thermal separation of the edge region of the cut-out 3, which is particularly prone to crack formation, from the receiving rails 4*a* and 4*b*. Only one edge region of the cut-out 3 is shown in FIG. 2. As a matter of course, a corresponding edge receiving plate is likewise to be attached, or can be attached, to the opposite edge of the cut-out 3. For purposes of clarity, this is not shown, however.

The invention is not limited to the depicted exemplary embodiments. As has been specified above, the mounting system according to the invention can be used in any suspended surface. It can also be used to install components other than light fixtures. All of the features described above, or shown in the Figures, can be combined arbitrarily within the scope of the invention. Furthermore, it is conceivable to subdivide the two interacting receiving rails into numerous segments, seen in the longitudinal direction thereof. The edge receiving plates can then be provided on the respective outermost receiving rails and/or at arbitrary joints of two receiving rails.

What is claimed is:

1. A lighting fixture system comprising:

a light fixture with a light fixture housing;

a ceiling or wall with a longitudinal cut-out having opposing lateral edges and end edges at the end regions of the cut-out;

a mounting system (1) for installing the light fixture, having two straight receiving rails (4*a*, 4*b*) each having a substantially L-shaped cross section, wherein the receiving rails (4*a*, 4*b*) each have a first leg (5*a*, 5*b*), which is configured to be attached to a front surface of the wall or an undersurface of the ceiling (2) at respective opposing lateral edges of the cut-out (3) in the wall or ceiling (2), and wherein the two receiving rails (4*a*, 4*b*) each have a second leg (6*a*, 6*b*), which is adapted to engage in, or extend into the cut-out (3) and to support the light fixture housing (10) of the light fixture, without rigidly connecting the light fixture housing (10) to the first legs (5*a*, 5*b*) of the receiving rails (4*a*, 4*b*);

wherein the receiving rails (4*a*, 4*b*) when installed are disposed at a defined first spacing (d1) to one another, measured between the second legs (6*a*, 6*b*), and the lateral edges of the cut-out (3) have a second spacing (d2), which is greater than the first spacing (d1), such that spacings (9*a*, 9*b*) occur between the second legs (6*a*, 6*b*) of the receiving rails (4*a*, 4*b*) and the lateral edges of the cut-out (3).

2. The lighting fixture system according to claim 1 wherein the second legs (6*a*, 6*b*) of the receiving rails (4*a*, 4*b*) have receiving elements (7*a*, 7*b*) adapted to support the light fixture housing (10), without rigidly connecting the light fixture housing (10) to the first legs (5*a*, 5*b*) of the receiving rails (4*a*, 4*b*).

3. The lighting fixture system according to claim 2, wherein the receiving elements (7*a*, 7*b*) are adapted to support the light fixture housing (10) in a floating manner, and the second legs (6*a*, 6*b*) of the receiving rails (4*a*, 4*b*) are flexible, such that they compensate for thermal size changes of the light fixture housing (10), without transferring these size changes to the first legs (5*a*, 5*b*) of the receiving rails (4*a*, 4*b*) or to the edges of the cut-out (3).

4. The lighting fixture system according to claim 2 wherein the receiving elements (7*a*, 7*b*) are designed to thermally decouple the light fixture housing (10) and the receiving rails (4*a*, 4*b*).

5. The lighting fixture system according to claim 1 wherein the receiving rails (4*a*, 4*b*) have plastering edges (8*a*, 8b), which are configured to enable the first legs (5*a*, 5*b*) to be plastered flush to a surface of the wall or ceiling (2).

6. The lighting fixture system according to claim 1 wherein the mounting system (1) has two edge receiving plates (13), which are configured to be attached in end regions of the cut-out (3), in order to connect the receiving rails (4*a*, 4*b*), and to thermally decouple the end regions of the cut-out (3) from the receiving rails (4*a*, 4*b*).

7. The lighting fixture system according to claim 1 wherein the second legs (6*a*, 6*b*) of the receiving rails (4*a*, 4*b*) are configured to retain covers and/or lenses, in a plane of the wall or ceiling (2).

8. The light fixture system according to claim 1, wherein the light fixture system has a housing receiving unit (12), which is disposed on a back surface of the wall or ceiling (2) in the region of the cut-out (3), encompasses and/or supports the light fixture housing (10), and closes off the cut-out (3) to the back surface of the wall or ceiling (2).

9. The light fixture system according to claim 1, wherein the second legs (6*a*, 6*b*) of the receiving rails (4*a*, 4*b*) are flexible, such that they compensate for thermal size changes of the light fixture housing (10), without transferring these size changes to the first legs (5*a*, 5*b*) of the receiving rails (4*a*, 4*b*) or to the edges of the cut-out (3).

10. The light fixture system according to claim 1, wherein the cut-out in the ceiling or wall is substantially rectangular.

11. The light fixture system according to claim 1, wherein each rail comprises numerous segments.

* * * * *